US009361863B1

(12) United States Patent
McClary

(10) Patent No.: US 9,361,863 B1
(45) Date of Patent: Jun. 7, 2016

(54) CAPO FOR RAISED STRINGED INSTRUMENTS

(71) Applicant: Charles Forrest McClary, Magnolia Springs, AL (US)

(72) Inventor: Charles Forrest McClary, Magnolia Springs, AL (US)

( * ) Notice: Subject to any disclaimer, the term of this patent is extended or adjusted under 35 U.S.C. 154(b) by 0 days.

(21) Appl. No.: 14/851,075

(22) Filed: Sep. 11, 2015

Related U.S. Application Data

(63) Continuation-in-part of application No. 14/201,894, filed on Mar. 9, 2014, now Pat. No. 9,196,231.

(51) Int. Cl.
*G10D 3/04* (2006.01)

(52) U.S. Cl.
CPC ..... *G10D 3/043* (2013.01)

(58) Field of Classification Search
CPC ..... G10D 13/02; G10D 13/026; G10D 13/00; G10G 5/005; G10G 5/00
See application file for complete search history.

(56) References Cited

U.S. PATENT DOCUMENTS

| | | | | |
|---|---|---|---|---|
| 4,252,046 | A | 2/1981 | Myerson et al. | |
| 4,671,156 | A | 6/1987 | Hathcock | |
| 6,958,439 | B1 | 10/2005 | White | |
| 7,390,948 | B2 * | 6/2008 | Walworth | G10D 3/043 84/318 |
| 2015/0255049 | A1 * | 9/2015 | McClary | G10D 3/043 84/318 |

* cited by examiner

*Primary Examiner* — Kimberly Lockett
(74) *Attorney, Agent, or Firm* — George L Williamson

(57) ABSTRACT

Method and apparatus for a capo for a raised string instrument. The capo has a base having a channel on its upper side for receiving a slidable wedge arm therein which slidable wedge arm has an upper sloped surface thereon. A cap disposed on an upper end of a lift pin rides on the upper sloped surface of the slidable wedge arm so that the cap and lift pin along with a string tension rod connected to the lift pin are raised or lowered as the wedge arm is moved along the channel. The action of the string tension rod being raised secures the strings between the string tension rod and the bottom of the base. Also, cushion tubes are installed on each end of the tension rod to assist in compressing the strings against the bottom of the base.

20 Claims, 2 Drawing Sheets

CAPO FOR RAISED STRINGED INSTRUMENTS

RELATED APPLICATION

This application is a continuation-in-part of U.S. patent application Ser. No. 14/201,894 filed on Mar. 9, 2014.

BACKGROUND OF THE INVENTION

1. Field of the Invention

The present invention relates generally to stringed musical instruments and, more particularly, is concerned with a capo for a raised stringed instrument such as a dobro, slide guitar, Hawaiian guitar, or similar raised stringed instrument. This type capo is sometimes referred to as a floating capo.

2. Description of the Related Art

Related devices have been described in the related art, however, none of the related art devices disclose the unique features of the present invention.

In U.S. Pat. No. 4,252,046 dated Feb. 24, 1981, Myerson, et al., disclosed a pressure bar for a capo. In U.S. Pat. No. 7,390,948 dated Jun. 24, 2008, Walworth disclosed a capo applicable to dobro and slide guitars. In U.S. Pat. No. 6,958,439 dated Oct. 25, 2005, White disclosed a dobro capo. In U.S. Pat. No. 4,671,156 dated Jun. 9, 1987, Hathcock disclosed a dobro capo.

While these related devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a capo for a raised string instrument which has a plurality of strings elevated above a fingerboard such as a dobro, slide guitar, Hawaiian guitar, or similar raised stringed instrument. The present invention has a base having a channel on its upper side for receiving a slidable wedge arm therein which slidable wedge arm has an upper sloped surface thereon. A cap disposed on an upper end of the lift pin contacts the upper sloped surface of the slidable wedge arm so that the cap and lift pin along with a string tension rod connected to the lift pin are raised or lowered as the wedge arm is moved along the channel. The action of the string tension rod being raised secures the strings between the string tension rod and the bottom of the base. Also, cushion tubes are installed on each end of the tension rod to assist in compressing the strings against the bottom of the base.

An object of the present invention is to provide an easy to use method for changing the key of a raised string instrument. A further object of the present invention is to provide a capo which can be installed on the neck of the instrument with one hand. A further object of the present invention is to provide a capo which is relatively inexpensive to manufacture.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
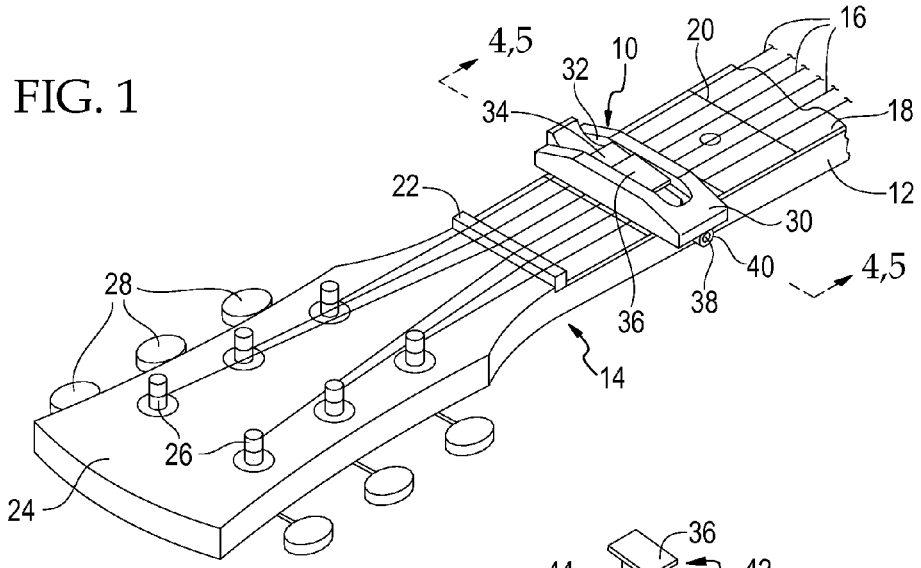
FIG. 1 is a perspective of the present invention shown in operative connection.

With regard to reference numerals used, the following numbering is used throughout the drawings.

10 present invention
12 neck
14 raised string instrument
16 string
18 fretboard
30 fret
22 nut
24 headstock
26 tuning pegs
28 tuning keys
30 main bar/base
31 underside of base
32 channel
34 sliding member/wedge
36 cap
38 tension rod
40 cushion tube
42 lift pin assembly
44 rod/pin
46 center hole
48 slot
50 notch
52 grip
54 recess
56 small hole
58 upper sloped surface
60 bottom of channel
62 side walls of channel

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a capo for a raised string instrument is disclosed and which is generally indicated by reference number 10.

Turning to FIG. 1, therein is shown the present invention 10 mounted onto the neck 12 of a conventional raised string instrument 14 having strings 16 disposed above a fretboard 18 having frets 20 thereon along with a nut 22 for elevating the strings above the fretboard; also shown is a headstock 24 having a plurality of tuning pegs 26 and tuning keys 28 thereon. The present invention 10 is disposed so that a longitudinal center line of the present invention is disposed perpendicular to a longitudinal center line of the neck 12 of the instrument 14. The present invention 10 has a base or main bar 30 having a channel 32 therein within which channel a sliding member 34 or wedge slides; also, there is a cap 36 which is connected to a tension rod 38 disposed underneath the strings 16. Also a cushion tube 40 or cover is placed over and around each end of the tension rod 38.

The capo of the present invention 10 is intended for use with resonator or resophonic guitars 14 or the like for changing the key that the instrument is to be played in, e.g., from the key of G to the key of A. This key change is accomplished by, in effect, shortening the string 16 length on guitars and other stringed instruments. This is accomplished by compressing the strings 16 of the instrument between the main bar or base 30 and a tension rod 38 at various positions along the instrument neck 12. Existing designs of capos tend to require several adjustments and possible use of both hands to install and make these adjustments. The sliding wedge arm 34 of the present invention 10 is unique in that it can be installed and adjusted very quickly using only one hand. Note, the capo of the present invention 10 is not intended for use with conventional guitars having strings which are depressed by the fingers of the hand of a user so that the strings are played, i.e., sounded, as the strings contact the surface of a fretboard.

Figure 2:
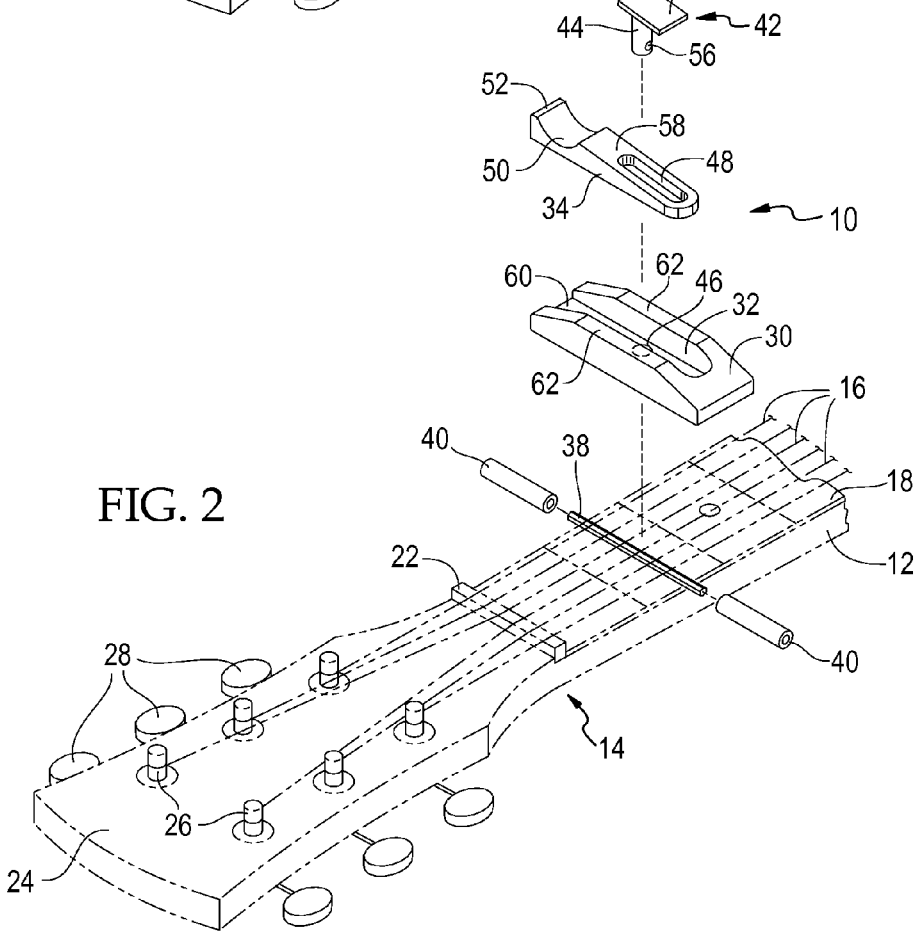
FIG. 2 is an exploded view of the present invention taken from the top.

Turning to FIGS. 2, therein is shown an exploded view of the present invention 10 shown in relation to the strings 16 of an instrument 14. The present invention 10 is assembled by inserting the sliding wedge arm 34 into an upper or top milled channel 32 of the main bar/base 30. Also provided is a lift pin assembly 42 having a flat alignment cap 36 on an upper end of rod or pin 44 with the pin inserted down through slot 48 of wedge 34 and the center hole 46 of the main bar 30 so that the alignment cap 36 is aligned with the milled slot 48 which slot extends longitudinally in the sliding member 34. Underneath the bottom or lower side of the main bar/base 30 the string tension rod 38 is inserted through the small hole or aperture 56 in the protruding lift pin 44. The string tension rod cushion tubes 40 are then installed over each end of the string tension rod 38 so that the lift pin 44 is centered on the string tension rod. The string tension rod cushion tube 40 will provide a cushion for the strings 16 of an instrument 14. Sliding member 14 is disposed in channel 32 of the base 30 and has an upper sloped surface 58 and a thumb or finger notch 50 forming a thumb or finger grip 52 thereon so that a thumb or finger of the user can quickly slide the sliding member 34. The generally U-shaped channel 32 is defined by a bottom surface 60 formed in base 30 along with a pair of upright standing side walls 62 with the channel 32 being open on one end so that thumb grip 52 end of the wedge 34 can extend outwardly from the channel with the channel being closed on an opposite end so as to capture the wedge inside the channel. The lower surface of the cap 36 contacts, i.e., rides on, the upper sloped surface of wedge 14 causing the tension rod 38 to be raised or lowered as the wedge moves along the channel 32 in the main bar/base 30. Other previously disclosed elements may also be shown.

Figure 3:
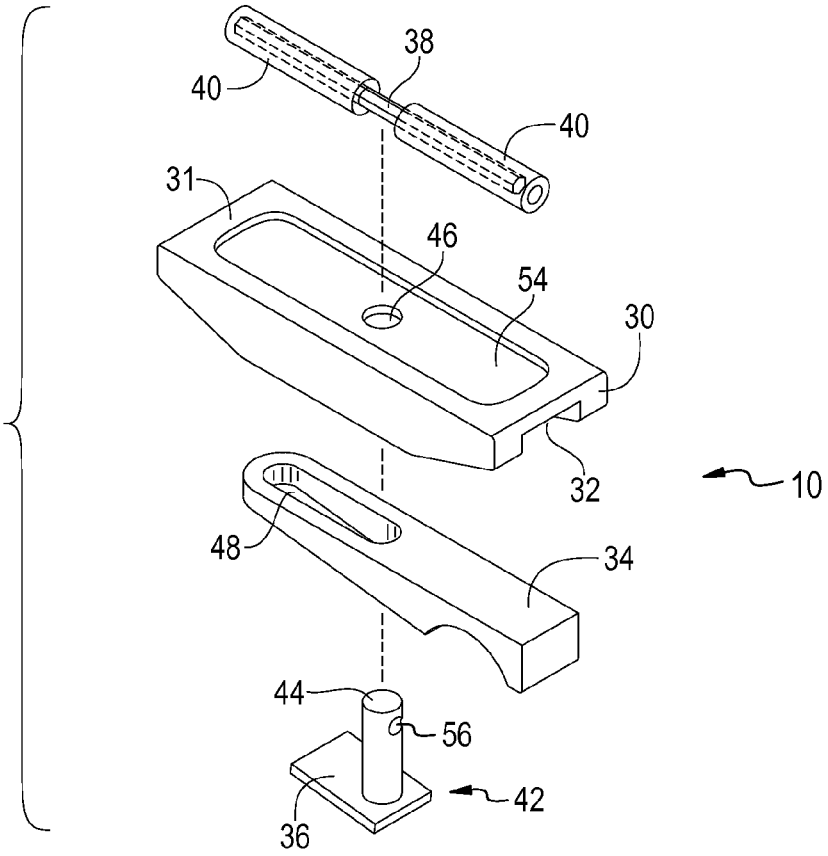
FIG. 3 is an exploded view of the present invention taken from the bottom.

Turning to FIG. 3, therein is shown a bottom exploded view of the present invention 10 showing the underside 31 of the base 30 having a recess 54 therein, wherein the recess is about the same length as the tension rod 38 and the pair of cushion tubes 40 thereon. Hole 46 is centered in the base 30 relative to the recess 54 and channel 32. It can be seen that pin 44 passes through slot 48 of sliding member 34 and hole 46 of base 30 and is centered on rod 38 with the rod passing through small hole 56. Cap 36 is also shown. Other previously disclosed elements may also be shown.

Figure 4:
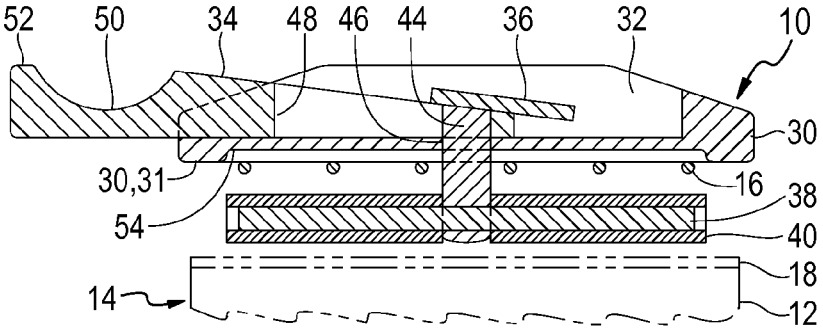
FIG. 4-5 are cross-sectional views of the present invention taken along a longitudinal center line of the present invention as indicated on FIG. 1.
Figure 5:
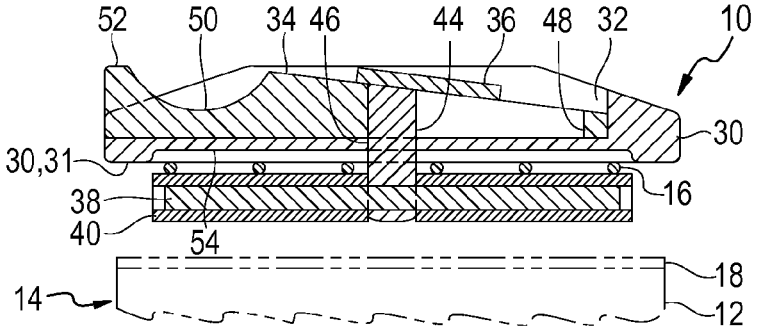

Turning to FIGS. 4 and 5, therein are shown cross-sectional views of the present invention 10 mounted above the fretboard 18 on the neck 12 of an instrument 14 with the strings 16 disposed between the underside 31 of base 30 and the upper surface of cushion tubes 40 on rod 38. FIG. 4 shows the wedge 34 in a first position in channel 32 of base 30 which causes the rod 38 to be in a lowered position as a result of the cap 36 resting on a thinner portion of the wedge, whereas FIG. 5 shows the wedge in a second position in the channel with the rod in a raised position as a result of the cap resting on a thicker portion of the wedge. It can be seen that lift pin 44 extends through slot 48 and center hole 46 and connects upper cap 36 to lower rod 38. Grip 52 is also shown on an end of wedge 34. FIG. 4 shows wedge 34 having its grip 52 end pulled out of channel 32 in a first position and FIG. 5 shows the wedge having its grip 52 end pushed into channel 32 in a second position for compressing the strings 16 between the rod 38 and a lower surface of the main bar 30. Other previously disclosed elements may also be shown.

The following paragraphs describe the detailed construction of the present invention 10 by making reference to FIGS. 1-5. The main bar/base 30 of the present invention 10 is expected to be made from a block of steel or other type of hard metal approximately ½" high by 1" wide and 2¾" long. The top milled channel 32 is ½" wide by 0.300-0.350" deep; the bottom recess 54 is 0.050" deep with side walls beveled inward 45°; a ¼" hole 46 is drilled in the center of the bar for lift pin, and, the top sides of the bar are tapered downward toward each end for cosmetic appearance and ease of use. All dimensions are approximate.

The sliding wedge arm 34 is expected to be made from a block of steel or other type of hard metal approximately ½" wide by ⅜" high, and 3" long. This block of metal tapers from ⅜" at one end to 1/32" on the other end. A slot 48 ¼" wide is centered in the wedge and the slot starts 3/16" from the thinner end and extends to 1⅛" from the thicker end. There is a thumb notch 50 milled in the thicker end to disengage the capo from the strings. All dimensions are approximate.

The lift pin assembly 42 has a ¼" diameter by ¾" long rod 44 with a ⅛" hole 56 ⅛" from one end and the lift pin alignment cap 36 is made of ½" wide by ¾" long by 1/16" thick steel or other type of hard metal welded to the top of the lift pin wherein a ¼" hole is drilled ¼" from one end of the cap and the lift pin is inserted into the hole and welded. The lift pin rod hole 56 must be aligned to be parallel with the cap 36 in order for string tension rod 38 to be aligned properly with the main bar 30. The string tension rod 38 is expected to be made from ⅛" hardened steel rod 2¾" long. All dimensions are approximate.

To install the capo of the present invention 10 onto an instrument 14, and with reference to FIGS. 1-5, one should grasp the capo's main bar 30 by its outer sides with thumb and fingers, then tilt the bar so the wedge 34 slides outwardly allowing the string tension rod 38 to drop downward to provide sufficient clearance for the strings 16. Next, place one's index finger on the cap 36 to hold it down and rotate the capo to be parallel with the strings of the instrument, then insert the string tension rod 38, and related assembly, in the space between the middle (between the 3rd and 4th strings) of the strings of the instrument, then set the capo on the strings of the instrument and rotate it 90° (to be crossways relative to the fretboard) and then press/move the sliding wedge arm inwardly to lock the capo in position thereby compressing the strings of the instrument between the tension arm cushions 40 and the underside of the main bar 30.

I claim:

1. A capo for a stringed instrument having raised strings, comprising:

(a) a main bar, said main bar having a channel therein and a first hole therein;

(b) a sliding member disposed within said main bar, said sliding member having an upper sloped surface and a slot therein;

(c) a pin, said pin having a cap disposed on an upper end thereof, said pin having a second hole therein;

(d) wherein a lower surface of said cap rests on said upper sloped surface of said sliding member and said pin extends downwardly through said slot of said sliding member and said first hole of said main bar;

(e) a rod extending through said second hole of said pin underneath said main bar; and, (f) said sliding member being slidable between first and second positions to raise and lower said cap riding on said upper sloped surface of said sliding member to raise and lower said rod for compressing the strings between said rod and a lower surface of said main bar when said sliding member is in said second position.

2. The capo of claim 1, wherein said slot extends longitudinally along said sliding member.

3. The capo of claim 1, further comprising a grip being disposed on an end of said sliding member.

4. The capo of claim 1, further comprising a cushion tube being disposed on said rod.

5. The capo of claim 1, wherein said lower surface of said main bar has a recess disposed therein.

6. The capo of claim 1, wherein said channel is U-shaped and disposed between a pair of upright standing side walls.

7. The capo of claim 6, wherein said channel is defined by a bottom surface of said main bar and said pair of upright standing side walls, said channel being open on one end so that said grip of said sliding member can extend outwardly from said channel and said channel being closed on an opposite end so as to capture said sliding member inside said channel.

8. The capo of claim 1, wherein said sliding member is wedge shaped.

9. A method for a capo for a stringed instrument having raised strings, comprising the steps of:

(a) providing a main bar having a channel therein and a first hole therein;

(b) providing a sliding member within the main bar, the sliding member having an upper sloped surface and a slot therein;

(c) providing a pin having a cap disposed on an upper end thereof, the pin having a second hole therein;

(d) wherein a lower surface of the cap rests on the upper sloped surface of the sliding member and the pin extends downwardly through the slot of the sliding member and the first hole of the main bar;

(e) extending a rod through the second hole of the pin underneath the main bar; and, (f) moving the sliding member between first and second positions to raise and lower the cap riding on the upper sloped surface thereof to raise and lower the rod for compressing the strings between the rod and a lower surface of the main bar when the sliding member is in the second position.

10. The method of claim 9, wherein the slot extends longitudinally along the sliding member.

11. The method of claim 9, further comprising the step of providing a grip on an end of the sliding member.

12. The method of claim 9, further comprising the step of providing a cushion tube on the rod.

13. The method of claim 9, wherein the lower surface of the main bar has a recess disposed therein.

14. The method of claim 9, wherein the channel is U-shaped and disposed between a pair of upright standing side walls.

15. The method of claim 14, wherein the channel is defined by a bottom surface of the main bar and the pair of upright standing side walls, the channel being open on one end so that the grip of the sliding member can extend outwardly from the channel and the channel being closed on an opposite end so as to capture the sliding member inside the channel.

16. The method of claim 9, wherein the sliding member is wedge shaped.

17. A capo for a stringed instrument having raised strings, comprising:

(a) a main bar having a sliding member disposed in a channel thereon so that as said sliding member slides between first and second positions, a rod disposed underneath said main bar moves upwardly or downwardly in response to movement of said sliding member;

(b) a cap having a lower surface riding on an upper surface of said sliding member, said cap having a downwardly extending pin connected thereto so that said pin extends through a hole in said main bar and a slot in said sliding member; and, (c) a rod connected to a lower end of said pin so that the strings are captured between said rod and a bottom of said main bar when said rod is in an upward position.

18. The capo of claim 17, wherein said slot extends longitudinally along said sliding member.

19. The capo of claim 17, further comprising a cushion tube being disposed on said rod.

20. The capo of claim 17, wherein said channel is U-shaped and disposed between a pair of upright standing side walls.

* * * * *